US005142112A

United States Patent [19]

Parks et al.

[11] Patent Number: 5,142,112

[45] Date of Patent: Aug. 25, 1992

[54] CIRCUIT BREAKER POSITIVE OFF INTERLOCK

[75] Inventors: David A. Parks, Baden; Thomas A. Whitaker, North Huntingdon; Yu W. Chou, Coraopolis, all of Pa.

[73] Assignee: Westinghouse Electric Corp., Pittsburgh, Pa.

[21] Appl. No.: 503,812

[22] Filed: Apr. 3, 1990

[51] Int. Cl.[5] ..... H01H 23/00

[52] U.S. Cl. ..... 200/401; 200/DIG. 42

[58] Field of Search ..... 200/401, DIG. 42, 400

[56] References Cited

U.S. PATENT DOCUMENTS

| | | | |
|---|---|---|---|
| 4,368,444 | 1/1983 | Preuss et al. | 200/401 |
| 4,489,295 | 12/1984 | Altenhof et al. | 335/20 |
| 4,546,224 | 10/1985 | Mostosi | 200/401 |
| 4,554,421 | 11/1985 | Grunert et al. | 200/43.15 |
| 4,638,277 | 1/1987 | Thomas et al. | 335/190 |
| 4,656,444 | 4/1987 | McKee et al. | 335/16 |
| 4,679,018 | 7/1987 | McKee et al. | 335/167 |
| 4,691,182 | 9/1987 | Mrenna et al. | 335/176 |
| 4,829,147 | 5/1989 | Schiefen et al. | 200/401 |
| 4,894,747 | 1/1990 | Livesey et al. | 361/376 |

*Primary Examiner*—Henry J. Recla
*Assistant Examiner*—David J. Walczak
*Attorney, Agent, or Firm*—M. J. Moran

[57] ABSTRACT

A molded case circuit breaker includes an interlock which prevents the operating handle from being placed in the off position after the main contacts have been welded together. By preventing the operating handle from being placed in an off position during such a condition, the operating handle will indicate the correct status of the main contacts and the operator will be made aware that the main contacts are welded together.

6 Claims, 4 Drawing Sheets

CIRCUIT BREAKER POSITIVE OFF INTERLOCK

CROSS-REFERENCE TO RELATED APPLICATIONS

The invention disclosed herein relates to molded case circuit breakers similar to the molded case circuit breaker described and claimed herein. The following patent applications all relate to molded case circuit breakers and were filed on Aug. 1, 1988: Ser. No. 226,503, entitled CROSS-BAR ASSEMBLY, by Jere L. McKee, Lance Gula and Glenn R. Thomas; and Ser. No. 226,655, entitled COMBINATION BARRIER AND AUXILIARY CT BOARD, by Gregg Nissly, Allen B. Shimp and Lance Gula abandoned and replaced by continuation filed Oct. 26, 1989, now U.S. Pat. No. 4,939,491, issued Jul. 3, 1990.

The following commonly assigned U.S. patent applications were filed on Oct. 12, 1988 and all relate to molded case circuit breakers similar to the molded case circuit breaker described and claimed herein: Ser. No. 256,881 entitled SCREW ADJUSTABLE CLINCH JOINT WITH BOSSES, by James N. Altenhof, Ronald W. Crookston, Walter V. Bratkowski, and J. Warren Barkell now abandoned and replaced by continuation filed Sep. 26, 1989, Ser. No. 256,879 entitled TAPERED STATIONARY CONTACT LINE COPPER, by Ronald W. Crookston now U.S. Pat. No. 4,950,853, filed Aug. 21, 1990.

The following commonly assigned U.S. patent applications also relate to molded case circuit breakers similar to the molded case circuit breaker described and claimed herein: Ser. No. 260,848, filed on Oct. 21, 1988, entitled UNRIVETED UPPER LINK SECUREMENT, by Joseph Changle and Lance Gula, now U.S. Pat. No. 4,951,020, issued Aug. 21, 1990, entitled ARC RUNNER CONTAINMENT SUPPORT ASSEMBLY, by Charles Paton, Kurt Grunert and Glen Sisson now U.S. Pat. No. 4,973,805, issued Nov. 17, 1990, EXTENDER SPRING FOR INCREASED MAGNETIC TRIP SETTINGS, by Kurt Grunert, now U.S. Pat. No. 4,973,928, issued Nov. 27, 1990.

The following two commonly owned patent applications related to molded case circuit breakers similar to the molded case circuit breaker described and claimed herein were filed on Apr. 25, 1989: Ser. No. 343,047, entitled TWO-PIECE CRADLE LATCH, KEY BLOCKS AND SLOT MOTOR FOR CIRCUIT BREAKER, by Alfred E. Maier, William G. Eberts and Richard E. White, now U.S. Pat. No. 5,027,096, issued Jun. 25, 1991 and Ser. No. 07/342,820, entitled TWO-PIECE CRADLE LATCH, HANDLE BARRIER LOCKING INSERT AND COVER INTERLOCK FOR CIRCUIT BREAKER by A. D. Carothers, D. A. Parks, R. E. White and W. G. Eberts, now U.S. Pat. No. 4,973,927, issued Nov. 27, 1990.

Commonly owned patent application Ser. No. 07/374,370 related to molded case circuit breakers similar to the molded case circuit breaker described and claimed herein was filed on Jun 30, 1989, entitled REVERSE SWITCHING MEANS FOR MOTOR OPERATOR, by Kurt Grunert and Charles Paton, now U.S. Pat. No. 4,990,873, issued Feb. 5, 1991.

Commonly owned patent application Ser. No. 07/389,849 related to molded case circuit breakers similar to the molded case circuit breaker described and claimed herein was filed on Aug. 14, 1989, entitled TRIP INTERLOCK DESIGN, by Kurt Grunert, Ronald Cheski, Robert Tedesco, Michael J. Whipple, Melvin A. Carrodus and James G. Maloney, now U.S. Pat. No. 4,963,846, issued Oct. 16, 1990.

Commonly owned patent application Ser. No. 706,713 (W. E. Case 56,248) was filed on May 29, 1991 to Henry R. Beck and Charles W. Pipich, entitled "Circuit Breaker With Positive On/Off Interlock".

Lastly, commonly owned patent application Ser. No. 07/491,329 related to molded case circuit breakers similar to the molded case circuit breaker described and claimed herein was filed on Mar. 9, 1990, entitled PINNED SHUNT EXPANSION JOINT by Lance Gula and Roger W. Helms now U.S. Pat. No. 5,032,813, issued Mar. 9, 1990.

BACKGROUND OF THE INVENTION

1. Field of the Invention

This invention relates to molded case circuit breakers and more particularly to an interlock which prevents the circuit breaker operating handle from being placed in an off position during a condition when the main contacts become welded together.

2. Description of the Prior Art

Molded case circuit breakers are generally old and well known in the art. Examples of such circuit breakers are disclosed in U.S. Pat. Nos. 4,489,295; 4,638,277; 4,656,444 and 4,679,018. Such circuit breakers are used to protect electrical circuitry from damage due to an overcurrent condition, such as an overload and relatively high level short circuit condition. An overload condition is normally about 200–300 percent of the nominal current rating of the circuit breaker. A high level short circuit condition can be 1000 percent or more of the nominal current rating of the circuit breaker.

Molded case circuit breakers include at least one pair of separable main contacts which may be operated either manually by way of an operating handle disposed on the outside of the case or automatically in response to an overcurrent condition. In the automatic mode of operation, the contacts may be opened by an operating mechanism, controlled by a trip unit, or by magnetic repulsion forces generated between the stationary and movable contacts during relatively high levels of overcurrent.

In one automatic mode of operation, the contact assemblies for all poles are tripped together by the trip unit which, in turn, actuates the mechanical operating mechanism causing the circuit breaker to trip. In the other automatic mode of operation, the contact arm assemblies are disengaged from the mechanical operating mechanism and are blown open by magnetic repulsion forces.

Under certain abnormal operating conditions, the separable main contacts may become fused or welded together due to the magnitude of the overcurrent and the time period that such an overcurrent flows through the main contacts. One such abnormal operating condition can occur when there is a failure or a partial failure (e.g., binding) of any of the components within the circuit breaker that relate to the tripping operation. More specifically, a failure of either the trip unit or the operating mechanism can result in either a failure or a delay of the main contacts in being separated during an overcurrent condition. This can result in heating of the main contacts to the point where they become at least partially molten and fuse or weld together.

After a predetermined time period, an upstream radial feed breaker will generally clear the overcurrent condition to allow the damaged circuit breaker to be removed to allow the main contacts to be replaced. However, maintenance personnel will be initially unaware that a problem with the circuit breaker exists. Accordingly, maintenance personnel will manually trip the circuit breaker (e.g., place the operating handle in the off position). This results in the operating handle indicating an incorrect status of the main contacts. More specifically, circuit breakers normally have three positions; an on position, an off position and a trip position. The on position normally indicates that the main contacts are closed. The off position normally indicates that the main contacts have been opened by the circuit breaker operating handle. The trip condition normally indicates the main contacts have been opened automatically by the trip unit.

The problem is even further complicated when the circuit breaker is padlocked in the off position when the main contacts are welded together. Accordingly, it is desirable to prevent the operator from placing and paclocking the operating handle in an off position when the main contacts are welded together.

SUMMARY OF THE INVENTION

It is an object of the present invention to provide a molded case circuit breaker that solves the problems associated with the prior art.

It is another object of the present invention to provide an interlock which prevents an operating handle of a molded case circuit breaker from being placed in an off position after the main contacts have been welded together.

Briefly, the present invention relates to a molded case circuit breaker which includes an interlock that prevents the operating handle from being placed in the off position after the main contacts have been welded together. By preventing the operating handle from being placed in an off position during such a condition, the operating handle will indicate the correct status of the main contacts and therefore the operator will be made aware that the main contacts are welded together.

DESCRIPTION OF THE DRAWING

These and other objects and advantages of the present invention will become readily apparent upon consideration of the following detailed description and attached drawing wherein.

DETAILED DESCRIPTION

Figure 3:
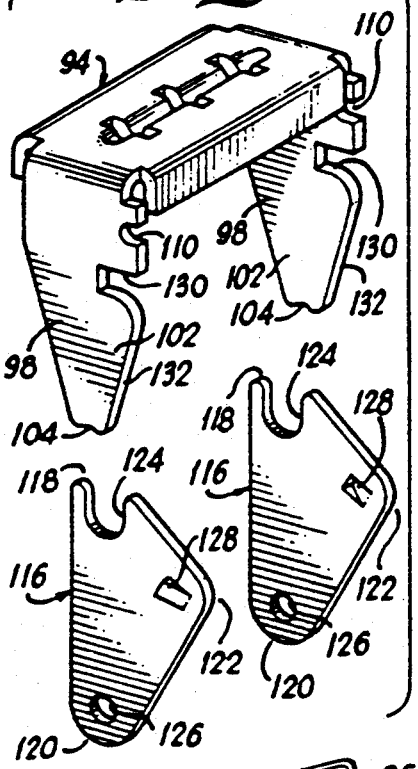
FIG. 3 is an exploded perspective view of two positive off arms and a handle yoke in accordance with the present invention.

A molded case circuit breaker, generally indicated by the reference numeral 20, comprises an electrically insulated housing 22 having a molded base 24 and a molded coextensive cover 26. The internal cavity of the molded base 24 is formed as a frame 30 for carrying the various components of the circuit breaker. As illustrated and described herein, a Westinghouse Series C, L-frame molded case circuit breaker will be described. However, it should be understood that the principles of the present invention are applicable to various types of molded case circuit breakers.

At least one pair of separable main contacts 32 are carried by the frame 30. More specifically, the pair of main contacts 32 may include a rigidly mounted main contact 34 and a movably mounted main contact 36. The rigidly mounted main contact 34 is mounted to a line side conductor 37. The line side conductor 37 may be, for example, as discussed in detail in U.S. Pat. No. 4,894,747, hereby incorporated by reference. The line side conductor 37 is attached to the frame 30 with a plurality of fasteners 40. The line side conductor 37 extends outwardly from the housing 22 to permit connection with an external electrical circuit.

The movable main contact 36 is carried by a contact arm 42. The contact arm 42 is pivotally connected to a load conductor assembly 44, for example, as discussed in detail in U.S. Pat. No. 4,894,747, hereby incorporated by reference. The load conductor assembly 44 includes a pivot bracket 46, rigidly connected to a load conductor base member 48. The load conductor base member 48 is rigidly mounted to the frame 30 and electrically connected to a load conductor 50. The load conductor 50 may form a portion of a trip unit 51. The trip unit 51 does not form a portion of the present invention. The trip unit 51 may be, for example, an electronic trip unit or a thermal magnetic trip unit as described in detail in U.S. Pat. Nos. 4,691,182 and 4,698,606, assigned to the same assignee as the present invention and hereby incorporated by reference.

One end of the conductor 50 is secured to the frame 30 and the load conductor base member 48. The other end of the conductor 50 is electrically connected to a load side terminal 53 to allow connection to an external electrical circuit.

The trip unit 51 also includes a latch mechanism 54 that is interlocked with an operating mechanism 55. Upon detection of an overcurrent condition, the trip unit 51 operates the latch mechanism 54 to unlatch the circuit breaker operating mechanism 55 to allow the main contacts 32 to be separated.

OPERATING MECHANISM

The operating mechanism 55 is provided for opening and closing the main contacts 32. The operating mechanism 55 includes a pair of upper toggle links 58 and a pair of lower toggle links 60 defining a toggle assembly 56. Each upper toggle link 58 is pivotally connected at one end to a lower toggle link 60 about a pivot axis 62. The other end of the lower toggle links 60 is pivotally connected about a pivot axis 63 to a U-shaped bracket 61 having depending operating arms 64. The U-shaped bracket 61 is rigidly connected to a crossbar 65. The operating arms 64 are disposed adjacent each side of the contact arms 42 and are pivotally connected to a pair of side plates 75 about a pivot axis 74.

The side plates 75 are disposed adjacent each side of the center pole and are used to support a portion of the operating mechanism 55. More specifically, aligned apertures in the side plates 75 define the pivot axis 74 for the crossbar 65. Another pair of aligned apertures in the side plates 75 define the pivot axis 97 for the cradle assembly 86. Another set of aligned apertures receive a stop pin 85 which limits rotation of the cradle assembly 86 during tripping of the main contacts 32. A V-shaped notch 91 in the side plates 75 captures a pivot pin 106 for the handle yoke 94. Lastly, an irregular slot 96 allows the crossbar 65 to rotate about the pivot axis 74. The side plates 75 may be rigidly connected to the molded base 24, for example, as discussed in detail in U.S. Pat. No. 4,894,747, assigned to the same assignee as the present invention and hereby incorporated by reference.

Figure 1:
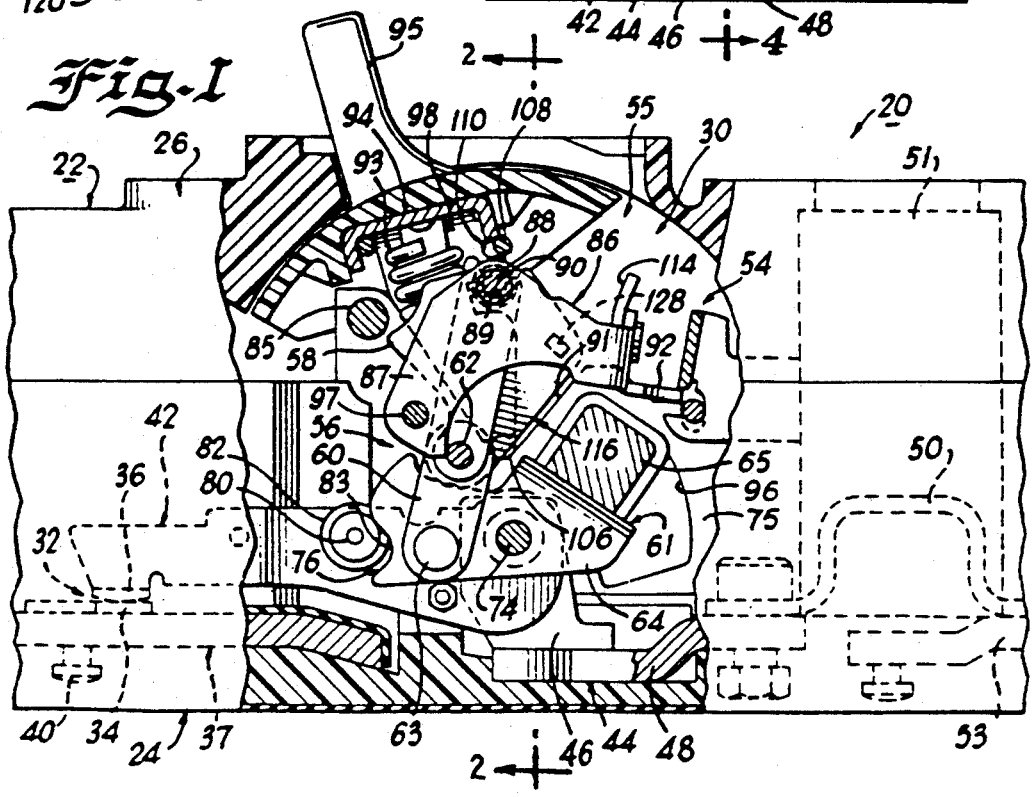
FIG. 1 is a side elevational view, partially broken away of a circuit breaker in the on position illustrating the interlock in accordance with the present invention.

The operating arms 64 are provided with cam surfaces 76. These cam surfaces 76 allow for mechanical coupling of the contact arms 42 to the operating mechanism 55. More specifically, each of the contact arms 42 are provided with a slot 78 for receiving a cam roller pin 80. The cam roller pin 80 extends outwardly from the sides of the contact arm 42. Cam rollers 82 are received on each end of the cam roller pin 80. The cam rollers 82 cooperate with the cam surfaces 76 to mechanically couple the contact arms 42 to the operating mechanism 55. In all conditions except a blown open condition, the cam rollers 82 are captured in a pocket 83 formed in the cam surfaces 76. In a blown open condition, the cam rollers 82 are displaced out of the pockets 83 by the magnetic repulsion forces to uncouple the operating mechanism 55 from the contact arm assembly 42. This allows the contact arms 42 to open independently of the operating mechanism 55. Biasing springs 84, coupled between the cam roller pin 80 and the pivot axis 74, provide contact pressure which must be overcome by the magnetic repulsion forces in order to allow the contact arm 42 to be blown open. More specifically, in the on position, since the cam rollers 82 are not quite seated in the pockets 83, but rather, are located slightly adjacent and upward of the pocket 83, the contact arm 42 is urged in a counterclockwise direction (FIG. 1) by the biasing springs 84, which produces a contact pressure between the main contacts 32.

The upper toggle links 58 are pivotally connected to the cradle assembly 86 about a pivot axis 88. More specifically, the upper toggle links 58 are provided with a U-shaped notch 89 at one end. A pivot pin 90 is supported by the cradle assembly 86. The cradle assembly 86 defines a pair of depending cradle arms 87, pivotally connected to the side plates 75 about a pivot axis 97.

The cradle assembly 86 is provided with a latch surface 92. The cradle assembly 86 may be, for example, as described in detail in U.S. Pat. No. 4,894,747, hereby incorporated by reference. The latch surface 92 cooperates with the latch mechanism 54 on the trip unit 51. More particularly, when the latch surface 92 is latched, operating springs 93, connected between the pivot axis 62 and handle yoke 94, bias the operating mechanism 55 to cause the upper toggle links 58 and the lower toggle links 60 to be disposed colinearly with respect to each other when the main contacts 32 are closed. In response to an overcurrent condition, the latch mechanism 54 on the trip unit 51 releases the latch surface 92 provided on the cradle assembly 86. The operating springs 93 then cause the cradle assembly 86 to rotate in a counterclockwise direction (FIG. 1) about the pivot axis 97 which causes the toggle assembly 56 to collapse. This causes the operating arms 64 and the attached crossbar 65 to rotate in a clockwise direction, thereby rotating the contact arms 42 and separating the main contacts 32.

The circuit breaker 20 can also be manually turned off by rotating an insulated operating handle 95, mechanically coupled to the handle yoke 94, in a clockwise direction to the off position This causes the toggle assembly 56 to collapse, which allows the contact arm 42 to rotate upwardly under the influence of the operating springs 93.

The handle yoke 94 is formed as a U-shaped member having two depending arms 98. The free ends 102 of the depending arms 98 are provided with notches 104 for capturing a pivot pin 106. The pivot pin 106 is carried by the V-shaped notches 91, provided in the side plates 75.

Once the latch surface 92 on the cradle assembly 86 has been disengaged from the latch mechanism 54 on the trip unit 51 during a tripping operation, it is necessary to reset the operating mechanism 55. This is accomplished by rotating the operating handle 95 in a clockwise direction until the latch surface 92 on the cradle assembly 86 engages the latch mechanism 54 on the trip unit 51.

A reset pin 108, carried by the operating handle 95, is captured in notches 110, provided in the upper portion of the depending arms 98 of the handle yoke 94. The reset pin 108, in turn, engages a reset surface 114 provided on the cradle assembly 86 when the operating handle 95 is rotated in a clockwise direction. Further rotation of the operating handle 95 causes the cradle assembly 86 to rotate in a clockwise direction until the latch surface 92 on the cradle assembly 86 engages and latches the latch mechanism 54 on the trip unit 51.

POSITIVE OFF INTERLOCK

An important aspect of the invention relates to a positive off interlock which prevents the handle yoke 94 from being rotated to an off position (FIG. 5), which indicates that the main contacts 32 are open, when the main contacts 32 are welded together The interlock also facilitates separating the welded main contacts 32 in some situations. This prevents maintenance personnel from being able to padlock a circuit breaker handle 95 during such a condition with a handle padlocking assembly (not shown), such as the assembly described in detail in U.S. Pat. No. 4,554,421, assigned to the same assignee as the present invention and hereby incorporated by reference.

Although the invention is capable of various different embodiments, four embodiments are described in detail below. The first embodiment, illustrated in FIGS. 1-7, relates to a positive off link. The second embodiment illustrated in FIGS. 8-9 also relates to a positive off link. The third embodiment, illustrated in FIGS. 10-12, relates to a positive off arm. The fourth embodiment, illustrated in FIGS. 15-18, relates to a positive off crossbar extension. Although the embodiments are structurally different, they all perform essentially the same function, namely, to prevent the handle yoke 94 from being moved to an off position (FIG. 5) when the main contacts 32 are welded together.

Referring to the first embodiment, the positive off link 116 is formed as a generally triangular-shaped member defining three apexes 118, 120 and 122. A generally U-shaped notch 124 is formed at the apex 118. Disposed adjacent the apex 120 is an aperture 126. An extending tab or protuberance 128 is disposed adjacent the apex 122.

Figure 2:
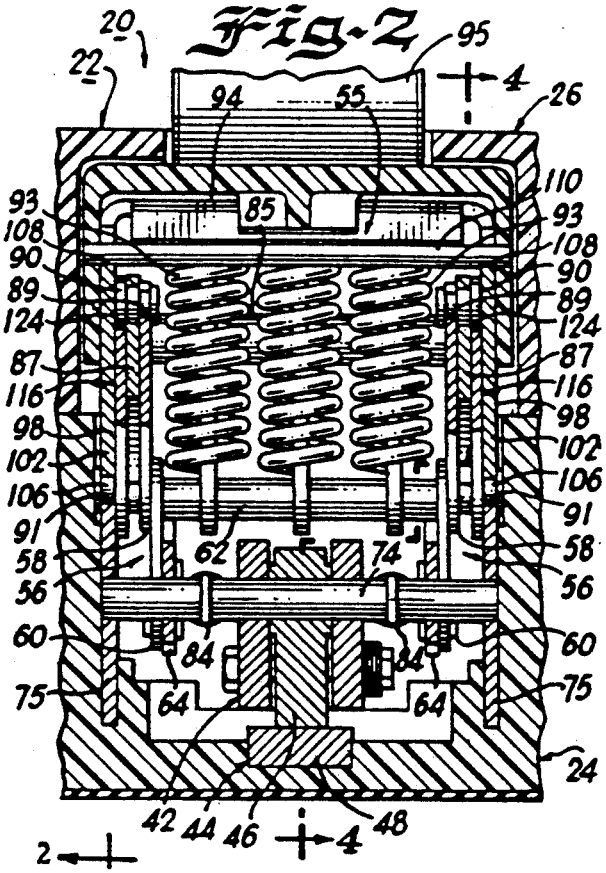
FIG. 2 is an enlarged cross-sectional view taken along line 2—2 of FIG. 1.

The positive off link 116 is disposed between the cradle arm 87 and the depending arms 98 of the handle yoke 94 (FIG. 2). The positive off link 116 is positioned such that the notch 124 is disposed about the pivot axis or rivet 90, used to pivotally connect the upper toggle links 58 to the cradle assembly 86. The pivot axis 62, which defines a knee joint for the upper toggle links 58 and the lower toggle links 60, is received in the aperture 126 which allows the positive off link 116 to pivot with the upper toggle links 58.

Figures 4, 5, 6, 7, 8, 9:
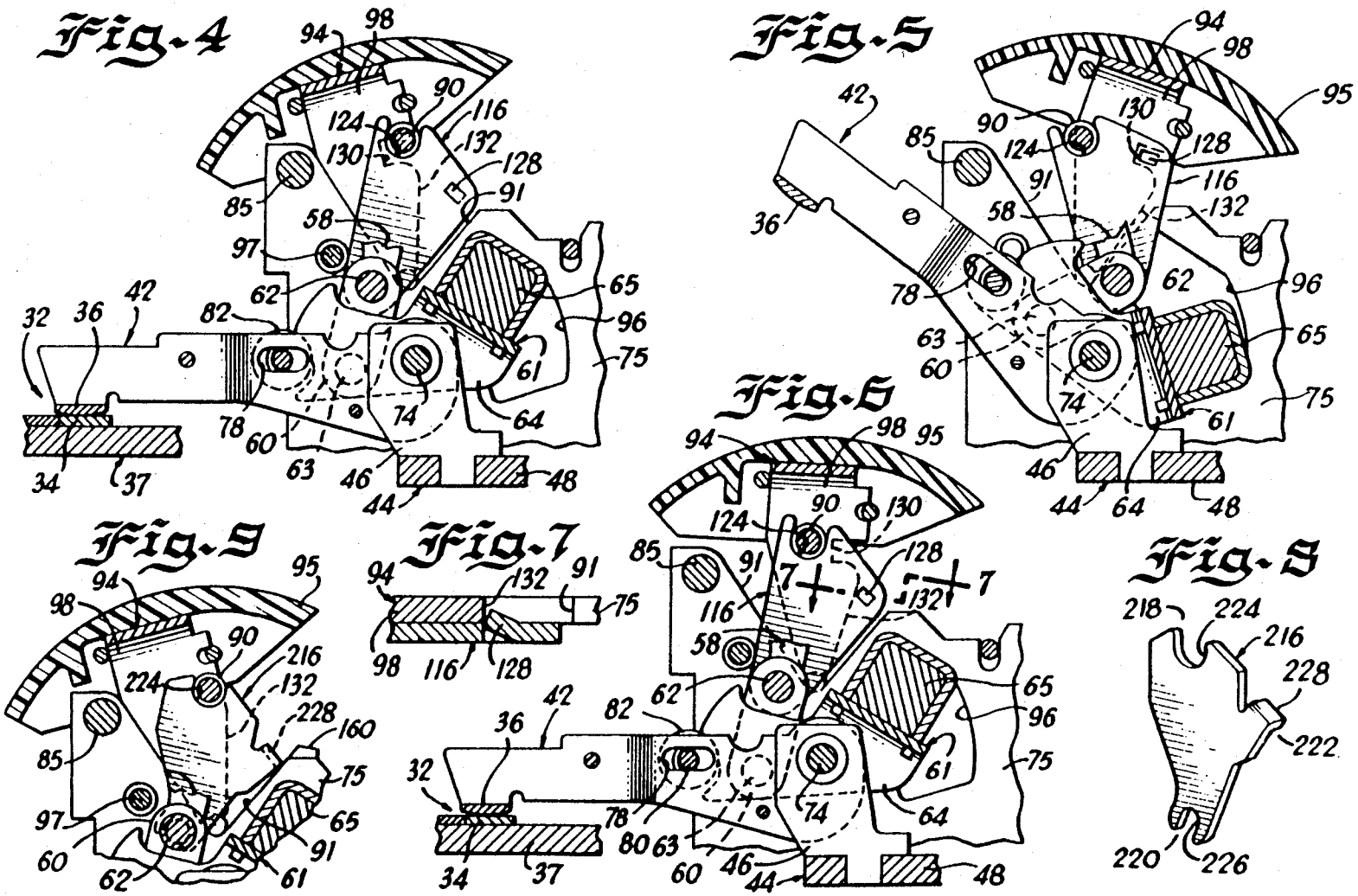
FIG. 4 is a cross-sectional view taken along line 4—4 of FIG. 2 with a portion of the elements deleted for clarity.
FIG. 5 is similar to FIG. 4 illustrating the circuit breaker in an off position.
FIG. 6 is similar to FIG. 4 illustrating the circuit breaker in a pre-off position.
FIG. 7 is an enlarged cross-sectional view taken along line 7—7 of FIG. 6.
FIG. 8 is a perspective view of an alternate embodiment of the interlock illustrated in FIGS. 1–7 in accordance with the present invention.
FIG. 9 is similar to FIG. 4 of the alternate embodiment illustrated in FIG. 8.

The tab 128 is adapted to cooperate with a notch 130, formed in the depending legs 98 of the handle yoke 94. During normal operation (e.g., when the main contacts 32 are not welded), the tab 128 is received in the notch 130 to allow the operating handle 95 to be placed in the closed position as shown in FIG. 5. However, during an abnormal condition (e.g., the main contacts 32 welded together), the tab 128 is not received in the notch 130 when the handle yoke 94 is moved toward the off position. Rather, in this condition, the tab 128 hits a surface 132 on the handle yoke 94, disposed adjacent and below the notch 130. The tab 128 hits the surface 132 in this condition because the pivot axis or knee joint 62 to which the positive off link 116 is attached is a movable pivot, which moves during a normal toggling operation. When the contacts 32 are welded together, the crossbar 65 is immovable. This, in turn, prevents normal toggling and prevents the movable pivot axis 62 from moving upwardly enough to allow the tab 128 to be aligned with the notch 130. Thus, in this condition, the tab 128 is stopped against the surface 132 on the handle yoke 94, when the handle yoke 94 is rotated in a clockwise direction (FIG. 6) during a condition when the main contacts 32 are welded together. Once the tab 128 engages the surface 132 on the handle yoke 94, further movement of the handle yoke 94 toward the off position is prevented.

It is also contemplated that in order to add additional strength to the mechanism, two positive off links 116 can be utilized as illustrated; one disposed adjacent each handle yoke 94. It is also contemplated that instead of using a separate member as a positive off link 116, the tab 128 can be formed in one or both of the upper toggle links 58. Both of these variations of the first embodiment will function in a similar manner as described above.

An alternate embodiment of the invention is illustrated in FIGS. 8 and 9. More specifically, a positive off link 216 is provided. The positive off link 216 is formed as a generally triangular-shaped member defining three apexes 218, 220 and 222. A notch 224 is provided adjacent the apex 218. This notch 224 receives the pin 90 in a similar manner as the positive off link 116. Another notch 226 is provided adjacent the apex 220. The notch 226 receives the pivot axis 62 similar to the positive off link 116. A bent over tab portion 228 is formed adjacent the apex 222. The tab portion 228 cooperates with an extended portion 160 formed on the side plates 75 as shown in FIG. 9. The extended portion 160 forms a support surface for the tab portion 228 which prevents the handle yoke 94 from being placed in an off position when the main contacts 32 are welded together. The positive off link 216 operates in a similar manner to the positive off link 116 but provides additional strength.

Figure 11:
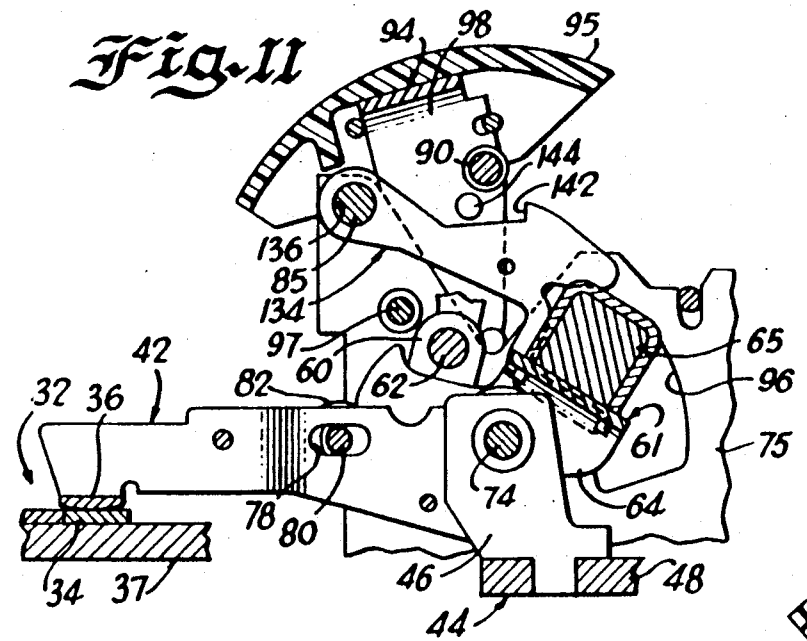
FIG. 11 is similar to FIG. 4 illustrating an alternate embodiment.
Figure 10:
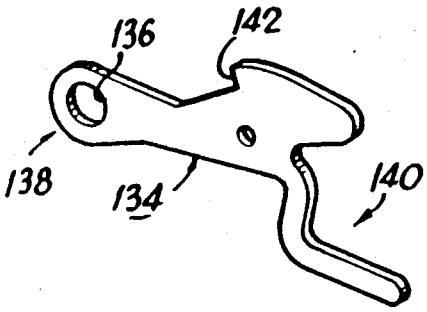
FIG. 10 is a perspective view of an alternate embodiment of the present invention.
Figure 16:
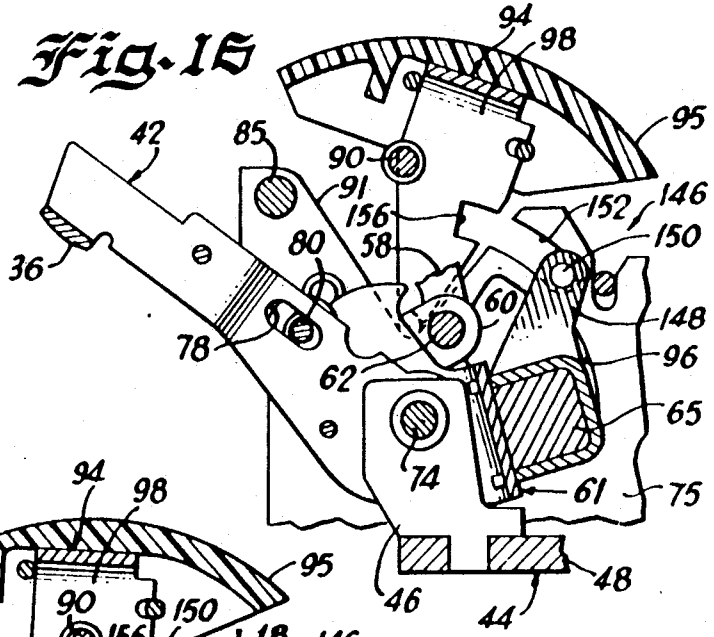
FIG. 16 is similar to FIG. 5 illustrating another alternate embodiment.
Figure 17:
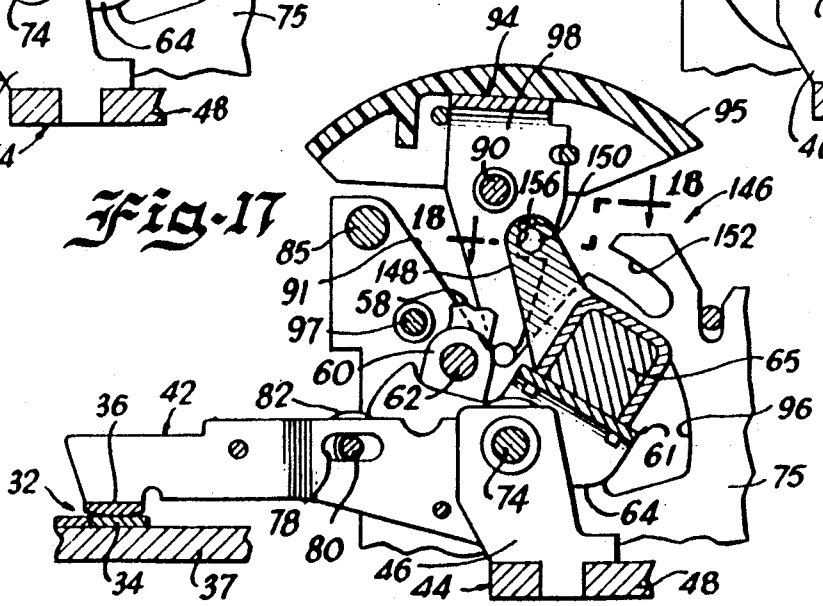
FIG. 17 is similar to FIG. 6 illustrating another alternate embodiment.
Figure 15:
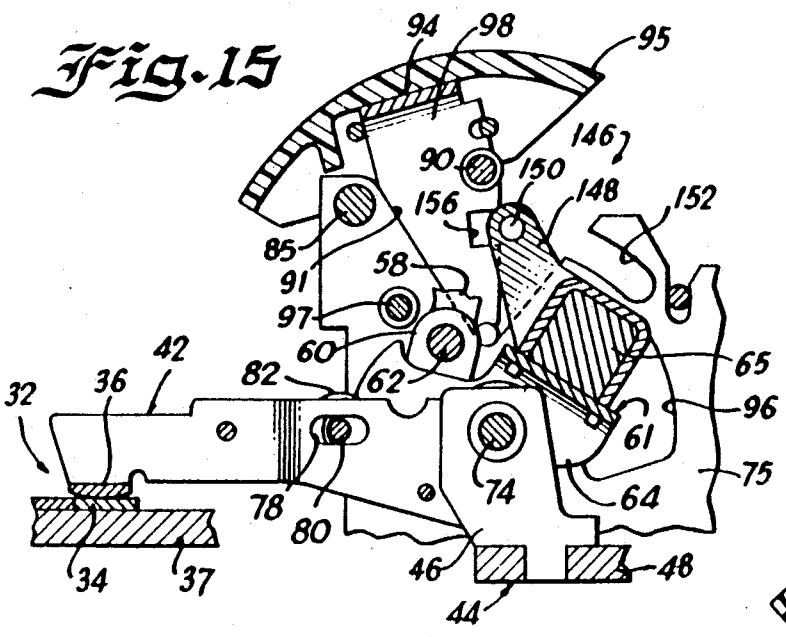
FIG. 15 is similar to FIG. 4 illustrating another alternate embodiment.
Figure 18:
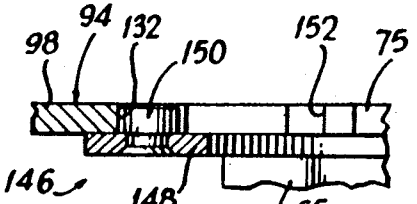
FIG. 18 is a cross-sectional view taken along line 18—18 of FIG. 17.

An alternate embodiment of the present invention is illustrated in FIGS. 10-14. In this embodiment, a positive off arm 134 is utilized as best illustrated in FIG. 10. The positive off arm 134 is formed as an irregular-shaped member and is provided with an aperture 136 at an end portion 138. The aperture 136 is adapted to receive the stop pin 85 which defines a fixed pivot axis for the positive off arm 134. The positive off arm 134 is disposed between the handle yoke 94 and the cradle arm 87 in a similar manner as the positive off link 116. Another portion 140 of the positive off arm 134 is formed in a generally L-shape. This L-shaped portion is adapted to be disposed about the crossbar 65 as best shown in FIG. 11. Disposed intermediate the end portion 138 and the L-shaped portion 140 is a stop surface 142. The stop surface 142 cooperates with a stop pin 144, rigidly attached to the handle yoke 94.

The principles of the present invention are equally applicable to embodiments where either one or two positive off arms 134 are utilized. The use of two positive off arms 134 will provide additional strength to the mechanism.

Figure 12:
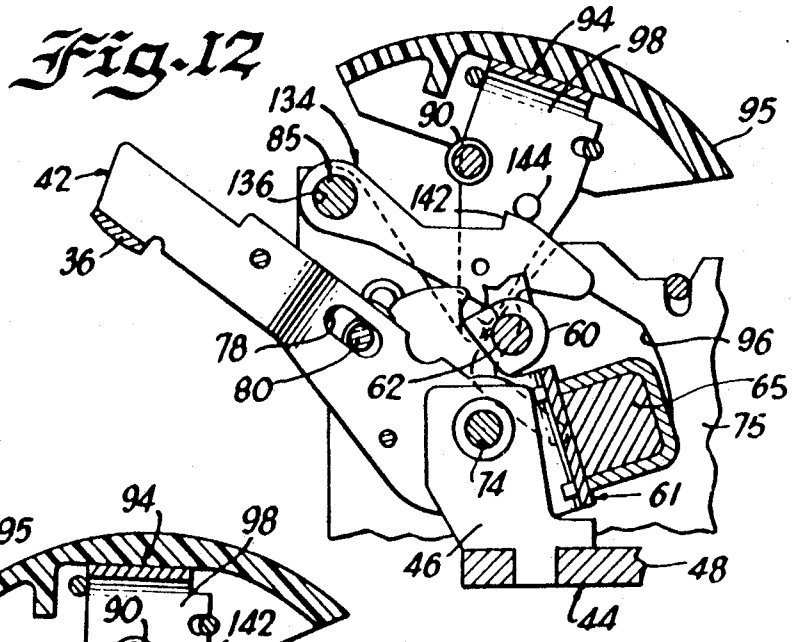
FIG. 12 is similar to FIG. 5 illustrating an alternate embodiment.
Figure 13:
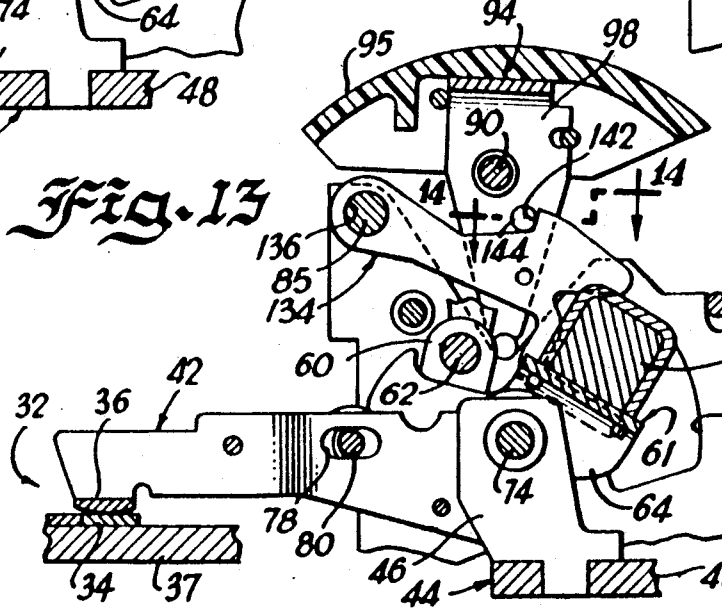
FIG. 13 is similar to FIG. 6 illustrating an alternate embodiment.
Figure 14:
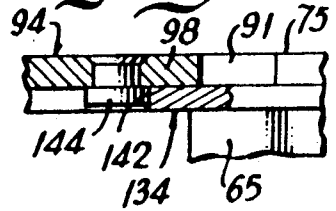
FIG. 14 is an enlarged cross-sectional view taken along line 14—14 of FIG. 13.

During a normal condition, when the handle yoke 94 is rotated toward the off position, the crossbar 65 rotates in a clockwise direction (FIG. 12), which causes the positive off arm 134 to rotate in a clockwise direction and downwardly such that the stop surface 142 is disposed below the stop pin 144, as best shown in FIG. 12. This action allows the operating handle 94 to be placed in the off position. However, during an abnormal condition, since the main contacts 32 are welded together, the crossbar 65 cannot rotate. The lack of rotation of the crossbar 65, in turn, leaves the positive off arm 134 in the position as shown in FIG. 13. In such a position, rotation of the handle yoke 94 toward the off position will cause the stop pin 144 to engage the stop surface 142 to prevent further rotation of the handle yoke 94 to the off position.

In another alternate embodiment of the invention as illustrated in FIGS. 15-18, a positive off crossbar extension assembly 146 is utilized. The crossbar extension assembly 146 may be formed with one or two brackets 148, rigidly attached to one or both ends of the crossbar 65 with a pin 150 rigidly attached thereto generally perpendicularly to each bracket 148. The pin 150 cooperates with an arcuate notch 152 formed in one or both of the side plates 75. More specifically, if one crossbar extension assembly 146 is utilized, then only one side plate 75 needs to be formed with an arcuate notch 152. Similarly, if two crossbar extension assemblies 146 are utilized, then both side plates 75 will need to be formed with notches 152.

During a normal condition, the crossbar 65 rotates in a clockwise direction when the handle yoke 94 is placed in an off position. Rotation of the crossbar 65, in turn, causes an arcuate rotation of the pin 150 allowing it to be received in the arcuate notch 152. However, during an abnormal condition, the crossbar 65 does not rotate when the handle yoke 94 is rotated toward the off position. In this condition, when the handle yoke 94 is rotated toward the off position, the surface 156 on the depending arms 98 of the handle yoke 94 engages the pin 150. Since the crossbar 65 and consequently the pin 150 are immobile in this condition, further movement of the handle yoke 94 toward the off position is prevented when the main contacts 32 are welded together.

Obviously, many modifications and variations of the present invention are possible in light of the above teachings. Thus, it is to be understood that, within the scope of the appended claims, the invention may be practiced otherwise than as specifically described hereinabove.

What is claimed and desired to be secured by a Letters Patent is:

1. A molded case circuit breaker comprising:

a base;

a pair of separable main contacts disposed within said base;

an operating mechanism including one or more toggle links, pivotally mounted about a first pivot axis and for operating said pair of separable main contacts;

an operating handle rigidly attached to a handle yoke defining a pair of depending arms mechanically coupled to said operating mechanism for selectively allowing said pair of separable main contacts to be placed in an off position; and preventing means for preventing said handle yoke from being placed in an off position during a predetermined condition, wherein said preventing means includes a link having an extending tab which cooperates with one of said depending arms to prevent said handle yoke from being placed in said off position during said predetermined condition, wherein said preventing means further includes a notch formed in one of said depending arms which cooperates with said extending tab.

2. A molded case circuit breaker comprising:

a base;

a pair of separable main contacts disposed within said base;

an operating mechanism including one or more toggle links, pivotally mounted about a first pivot axis and for operating said pair of separable main contacts;

operating handle rigidly attached to a handle yoke defining a pair of depending arms mechanically coupled to said operating mechanism for selectively allowing said pair of separable main contacts to be placed in an off position; and preventing means for preventing said handle yoke from being placed in an off position during a predetermined condition, wherein said preventing means includes link having an extending tab which cooperates with one of said depending arms to prevent said handle yoke from being place in said off position during said predetermined condition, wherein said link pivots about said first pivot axis.

3. A molded case circuit breaker comprising:

a base;

a pair of separable main contacts disposed within said base;

an operating mechanism including one or more toggle links, pivotally mounted about a first pivot axis and for operating said pair of separable main contacts;

an operating handle rigidly attached to a handle yoke defining a pair of depending arms mechanically coupled to said operating mechanism for selectively allowing said pair of separable main contacts to be placed in an off position; and means for preventing said handle yoke from being placed in a predetermined position during a predetermined condition, wherein said preventing means includes a tab formed on one of said toggle links.

4. A molded case circuit breaker comprising:

a base;

a pair of separable main contacts disposed within said base;

an operating mechanism including one or more toggle links, pivotally mounted about a first pivot axis and for operating said pair of separable main contacts;

an operating handle rigidly attached to a handle yoke defining a pair of depending arms mechanically coupled to said operating mechanism for selectively allowing said pair of separable main contacts to be placed in an off position; and preventing means for preventing said handle yoke from being placed in an off position during a predetermined condition, wherein said preventing means includes a toggle link having an extending tab which cooperates with one of said depending arms to prevent said handle yoke from being placed in said off position during said predetermined condition.

5. A molded case circuit breaker comprising:

a base;

a pair of separable main contacts disposed within said base;

an operating mechanism including one or more toggle links, pivotally mounted about a first pivot axis and for operating said pair of separable main contacts;

an operating handle rigidly attached to a handle yoke defining a pair of depending arms mechanically coupled to said operating mechanism for selectively allowing said pair of separable main contacts to be placed in an off position; and means for preventing said handle yoke from being placed in a predetermined position during a predetermined condition, wherein said preventing means includes a pair of links with tabs which cooperate with said depending arms on said handle yoke, wherein said preventing means further includes a notch formed in each of said depending arms for engaging said tabs on said links for preventing said yoke from being placed in said predetermined position during said predetermined condition.

6. A molded case circuit breaker comprising:

a base;

a pair of separable main contacts disposed within said base;

an operating mechanism including one or more toggle links, pivotally mounted about a first pivot axis for operating said pair of separable main contacts;

an operating handle rigidly attached to a handle yoke defining a pair of depending arms mechanically coupled to said operating mechanism for selectively allowing said pair of separable main contacts to be placed in an on position or alternatively in an off position; and preventing means for preventing said handle yoke from being placed in the off position during a predetermined condition, said preventing means including a toggle link having an extending tab which cooperates with one of said depending arms to prevent said handle yoke from being placed in said off position during said predetermined condition, said latter toggle being pivotably mounted about a predetermined axis which is movable under predetermined operating conditions of said operating mechanism.

* * * * *